US007216419B2

(12) United States Patent
Kusano

(10) Patent No.: US 7,216,419 B2
(45) Date of Patent: May 15, 2007

(54) METHOD OF MANUFACTURING A HIGH-FREQUENCY COIL DEVICE

(75) Inventor: Hidetoshi Kusano, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/218,812

(22) Filed: Sep. 2, 2005

(65) Prior Publication Data

US 2006/0001519 A1 Jan. 5, 2006

Related U.S. Application Data

(60) Continuation of application No. 10/675,659, filed on Sep. 30, 2003, now Pat. No. 6,940,385, which is a division of application No. 09/915,772, filed on Jul. 26, 2001, now abandoned.

(30) Foreign Application Priority Data

Aug. 4, 2000 (JP) ..... 2000-236900

(51) Int. Cl.
*H01F 7/06* (2006.01)

(52) U.S. Cl. ..... 29/606; 29/592.1; 29/602.1; 29/603.23; 29/831; 29/832; 29/837; 336/65; 336/83; 336/90; 336/200; 336/206; 336/323

(58) Field of Classification Search ..... 29/592.1, 29/602.1, 603.23, 606, 831, 832, 837; 336/65, 336/83, 90–96, 200, 206–208, 323
See application file for complete search history.

(56) References Cited

U.S. PATENT DOCUMENTS 6,413,651 B1 * 7/2002 Yan et al. ..... 428/592

FOREIGN PATENT DOCUMENTS

JP 03136220 A * 6/1991
JP 06334507 A * 12/1994
JP 09069457 A * 3/1997

OTHER PUBLICATIONS

"RF front end for a 4.1 Tesla clinical NMR spectrometer"; Vaughan, J.T.; Haupt, D.N.; Noa, P.J.; Vaughn, J.M.; Pohost, G.M.; Nuclear Science, IEEE Transactions on vol. 42, Issue 4, Part 1-2, Aug. 1995 pp. 1333-1337.*

* cited by examiner

*Primary Examiner*—Paul D. Kim
(74) *Attorney, Agent, or Firm*—Robert J. Depke; Rockey, Depke, Lyons & Kitzinger LLC.

(57) ABSTRACT

In a high-frequency coil device having small dispersion in coil inductance and suitable for use in GHz band and a method of manufacturing the high-frequency coil device, a spirally-shaped fine-pitch coil is embedded in the surface of a polyimide layer as a dielectric substrate so that the bottom surface and side surface of the coil is covered by the polyimide layer. The spirally-shaped coil has an Ni—Cu laminate structure in which an Ni plating layer and a Cu plating layer are laminated, and also the side surface thereof is made substantially vertical while the width thereof is uniform with high precision. The surface of the spirally-shaped coil, that is, the surface of the Ni plating layer serving as the upper layer is coated with an Au plating layer.

6 Claims, 8 Drawing Sheets

METHOD OF MANUFACTURING A HIGH-FREQUENCY COIL DEVICE

The subject matter of U.S. patent application Ser. No. 10/675,659 is incorporated herein by reference. The present application is a continuation of U.S. Pat. No. 10/675,659, filed Sep. 30, 2003, which will issue as U.S. Pat. No. 6,940,385 on Sep. 6, 2005, which is a divisional of U.S. patent application Ser. No. 09/915,772, filed Jul. 26, 2001, now abandoned, which claims priority to Japanese Patent Application No. JP2000-236900, filed Aug. 4, 2000. The present application claims priority to these previously filed applications.

BACKGROUND OF THE INVENTION

1. Field of the Invention

The present invention relates to a high-frequency coil device and a method of manufacturing the same, and particularly to a high-frequency coil device of fine pitch for GHz and a method of manufacturing the same.

2. Description of the Related Art

A conventional high-frequency coil device will be described with reference to FIGS. 10A, 10B and 10C Here, FIG. 10A is a cross-sectional view showing a conventional high-frequency coil device, FIG. 10B is a cross-sectional view taken along a line C—C of FIG. 10A, and FIG. 10C is a partially enlarged view of FIG. 10B.

As shown in FIGS. 10A, 10B and 10C, a spirally-shaped coil 32*a* formed of a convex-shaped Cu (copper) layer having a thickness of, for example, 15 to 25 μm is formed on a dielectric substrate 30 formed of polyimide resin having a thickness of, for example, 20 to 30 μm. The surface of the spirally-shaped coil 32*a* is covered by an Au plating layer 36 having a thickness of 0.3 to 5 μm.

Here, the material of the dielectric substrate 30 is not limited to polyimide resin, and epoxy resin or phenol resin can be used.

A signal line 38 having the same structure as the spirally-shaped coil 32*a* is disposed so as to be adjacent to the spirally-shaped coil 32*a*. The surface of this signal line 38 is coated with the Au plating layer 36 as in the case of the spirally-shaped coil 32*a*.

The center portion of the spirally-shaped coil 32*a* (more accurately, the Au plating layer 36 coated on the surface of the coil 32*a* at the center portion) and the signal line 38 (more accurately, the Au plating layer 36 coated on the surface of the signal line 38) are connected to each other by an Au wire 40, thereby constructing a high-frequency coil device having such a structure that the spirally-shaped coil 32*a* formed of the convex-shaped Cu layer is formed on the dielectric substrate 30.

Next, a method of manufacturing the conventional high-frequency coil device will be described with reference to the cross-sectional views of FIGS. 11 to 15.

First, as shown in FIG. 11, the Cu layer 32 having a thickness of 15 to 25 μm is formed on the dielectric substrate 30 of polyimide resin having a thickness of 20 to 30 μm. Subsequently, as shown in FIG. 12, a resist film is coated on the Cu layer 32, and then the resist film is patterned in a spiral shape having a fine pitch by using the photolithography technique to form a resist pattern 34.

Subsequently, as shown in FIG. 13, the Cu layer 32 is selectively etched and removed by using the resist pattern 34 as a mask, and then the resist pattern 34 is peeled off as shown in FIG. 14. As described above, a coil 32*a* comprising the convex-shaped Cu layer 32 which is patterned in the spiral shape is formed on the dielectric substrate 30.

Subsequently, as shown in FIG. 15, Au (gold) plating treatment is carried out on the spirally-shaped coil 32*a* to coat the surface and side surface of the spirally-shaped coil 32*a* with the Au plating layer 36.

Finally, as shown in FIG. 10A, a wire bonding is carried out so that the central portion of the spirally-shaped coil 32*a* (more accurately, the Au plating layer 36 coated on the surface of the coil 32*a* at the center portion) and the signal line 38 formed simultaneously with the coil 18 in the same process (more accurately, the Au plating layer 36 coated on the surface of the signal line) are connected to each other by an Au wire 40.

As described above, a high-frequency coil device having a spirally-shaped coil 32*a* formed of a convex-shaped Cu layer 32 which is coated with the Au plating layer 36 is formed on the surface and side surface thereof.

In the above conventional high-frequency coil device, since the spirally-shaped coil 32*a* formed of the convex-shaped Cu layer 32 is formed by selectively etching the Cu layer 32 with the resist pattern 34 as a mask, the section of the coil 32*a* has a trapezoidal shape having inclined side surfaces as shown in FIG. 14 and FIG. 10C. Therefore, dispersion occurs in the sectional area, and thus the dispersion of the coil inductance is intensified.

That is, it has been difficult for the conventional high-frequency coil device to manufacture a high-frequency coil device for GHz which needs a fine-pitch coil having small dispersion in coil inductance.

SUMMARY OF THE INVENTION

The present invention has been implemented in view of the foregoing circumstance, and has an object to provide a high-frequency coil device that has small dispersion in coil inductance and is suitably usable for GHz band, and a method of manufacturing the high-frequency coil device.

In order to attain the above object, a high-frequency coil device according to a first aspect of the present invention, is characterized by comprising a dielectric substrate, and a coil that is embedded in the surface of the dielectric substrate so as to have a predetermined coil pattern, the bottom surface and the side surface thereof being coated with a dielectric substrate.

In the high-frequency coil device according to the first aspect of the present invention, the coil formed of the conductive layer having the predetermined coil pattern is embedded in the surface of the dielectric substrate, and the bottom surface and the side surface of the coil are covered by the dielectric substrate, whereby a stable Q value can be achieved, and thus a high-frequency coil device having a stable Q value for GHz band can be implemented. Further, the surface of the high-frequency coil device comprising the coil and the dielectric substrate is set to be substantially flat, and thus another semiconductor integrated circuit chip can be easily joined to the device.

According to a second aspect of the present invention, in the high-frequency coil device of the first aspect of the present invention, a recess is formed in the surface of the dielectric substrate, and the coil is designed in an aerial wire structure in which the coil is separated from the dielectric substrate in the recess, so that the Q value is further enhanced and a high-frequency coil device having a stable and high Q value for GHz band can be implemented.

According to a third aspect of the present invention, a method of manufacturing a high-frequency coil device is characterized by comprising: a first step of forming a resist pattern constituting a predetermined coil pattern on the surface of a base metal plate; a second step of conducting a plating treatment on an exposed portion of the surface of the base metal plate by using the resist pattern as a mask to form a coil of the plating layer of the predetermined coil pattern; a third step of removing the resist pattern and then forming a resin layer on the surface of the base metal plate containing the coil to coat the surface and side surface of the coil with the resin layer; and a fourth step of etching and removing the base metal plate from the back surface side to expose the back surfaces of the coil and the resin layer.

In the high-frequency coil device manufacturing method according to the third aspect of the present invention, when the resist pattern constituting the predetermined coil pattern is formed on the surface of the base metal plate, the resist pattern is formed so as to have a substantially vertical side wall and a highly precisely uniform pattern interval by a micro-processing technique. Further, the plating layer is formed on the exposed surface of the based metal plate by using the resist pattern as a mask to thereby form the coil of the plating layer. Therefore, the side surface of the coil is made substantially vertical, and the width thereof is uniform with high precision, whereby dispersion in sectional area can be suppressed at maximum. Accordingly, dispersion of the coil impedance can be reduced. Further, since the dispersion of the coil impedance is reduced, a high-frequency coil device having a high Q value for GHz band can be implemented.

Resin such as polyimide resin or liquid crystal polymer resin is suitably used as the material of the dielectric substrate of the high-frequency coil device. Further, the plating layer constituting the coil is preferably designed in such a multilayer structure that a nickel plating layer and a copper plating layer are laminated.

DETAILED DESCRIPTION OF THE PREFERRED EMBODIMENTS

Preferred embodiments according to the present invention will be described hereunder with reference to the accompanying drawings.

(First Embodiment)

Figure 1A:
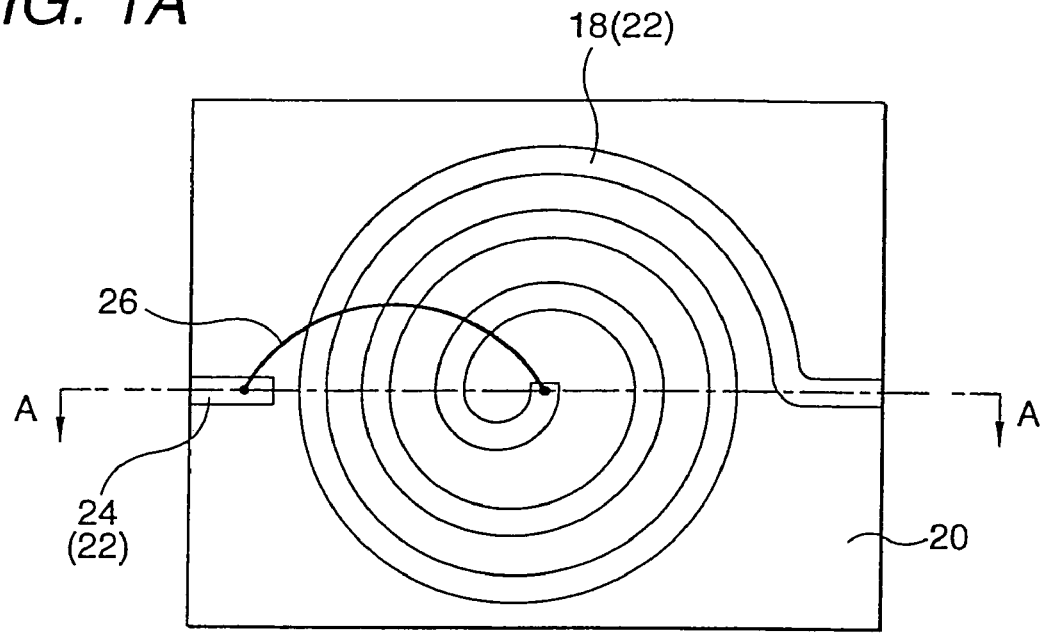
FIG. 1A is across-sectional view showing a high-frequency coil device according to a first embodiment of the present invention.
Figure 1B:
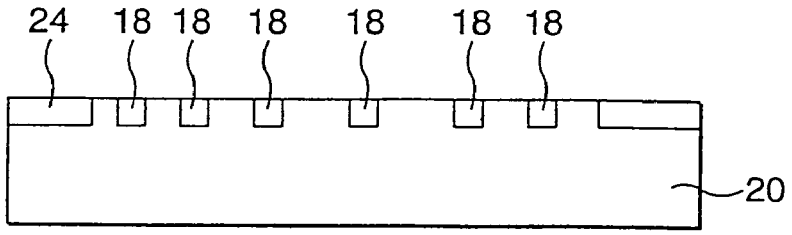
FIG. 1B is a cross-sectional view taken along a line A—A of FIG. 1A.
Figure 1C:
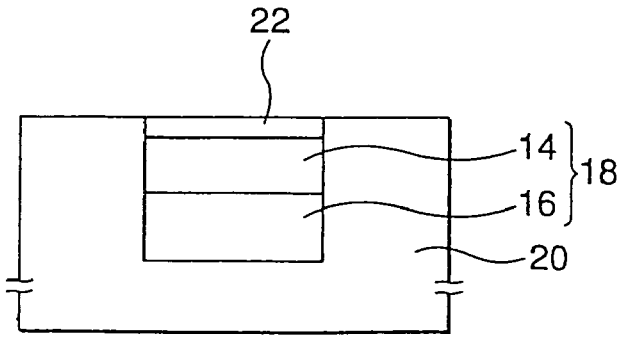
FIG. 1C is a partially enlarged view of FIG. 1B.

FIG. 1A is a cross-sectional view showing a high-frequency coil device according to a first embodiment of the present invention, FIG. 1B is a cross-sectional view taken along a line A—A of FIG. 1A, and FIG. 1C is a partially enlarged view of FIG. 1B. FIGS. 2 to 8 are cross-sectional views showing a method of manufacturing a high-frequency coil device according to the embodiment of the present invention.

In the high-frequency coil device according to this embodiment, a coil 18 having a fine-pitch spiral shape as a predetermined coil pattern is embedded in the surface of a polyimide layer 20 as a dielectric substrate as shown in FIGS. 1A, 1B and 1C. That is, the bottom surface and the side surface of the spirally-shaped coil 18 are coated by the polyimide layer 20.

The surface of the spirally-shaped coil 18 that is not coated with the polyimide layer 20 is coated with an Au plating layer 22 having a thickness of 0.3 to 5 μm. The surface of the Au plating layer 22 coated on the surface of the spirally-shaped coil 18 and the surface of the polyimide layer 20 form substantially the same plane (i.e., flushed).

The spirally-shaped coil 18 is designed in an Ni—Cu laminate structure in which an Ni (nickel) plating layer 14 having a thickness of 15 μm and a Cu plating layer 16 having a thickness of 25 μm are laminated so that the side surface there of is substantially vertical and the width thereof is uniform with high precision. Therefore, the Au plating layer 22 on the surface of the coil 18 is directly coated on the surface of the Ni plating layer 14 serving as the upper layer of the coil.

Further, a signal line 24 having the same Ni—Cu laminate structure as the spirally-shaped coil 18 is disposed so as to be adjacent to the spirally-shaped coil 18. The surface of the signal line 24 is also coated with the Au plating layer 22 as in the case of the spirally-shaped coil 18.

The center portion of the spirally-shaped coil 18 (more accurately, the Au plating layer 22 coated on the surface of the coil 18 at the center portion) and the signal line 24 (more accurately, the Au plating layer 22 coated on the surface of the signal line 24) are connected to each other by an Au wire 26.

As described above, there can be achieved a high-frequency coil device having such a structure that the spirally-shaped coil 18 having a fine pitch is embedded in the surface of the polyimide layer 20, the bottom surface and the side surface thereof are coated by the polyimide layer 20, and the surface of the Au plating layer 22 coated on the surface of the spirally-shaped coil 18 and the surface of the polyimide layer 20 form substantially the same plane.

Next, a method of manufacturing the high-frequency coil device according to this embodiment will be described with reference to FIGS. 2 to 8.

The cross-sectional views of FIGS. 2 to 8 correspond to FIG. 1B. However, since the upper and lower sides of FIGS. 2 to 8 are illustrated as being inverted with respect to FIG. 1B, the "surface" and the "back surface" of constituent elements may be represented as being opposite to those in the foregoing description. Further, the signal line 24 of FIG. 1 is formed simultaneously with the spirally-shaped coil 18 in the same process, however, the illustration thereof is omitted.

Figure 2:
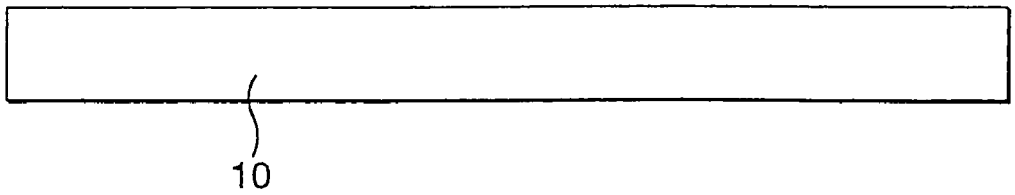
FIG. 2 is a cross-sectional view (part 1) showing a method of manufacturing the high-frequency coil device according to the first embodiment of the present invention.
Figure 3:
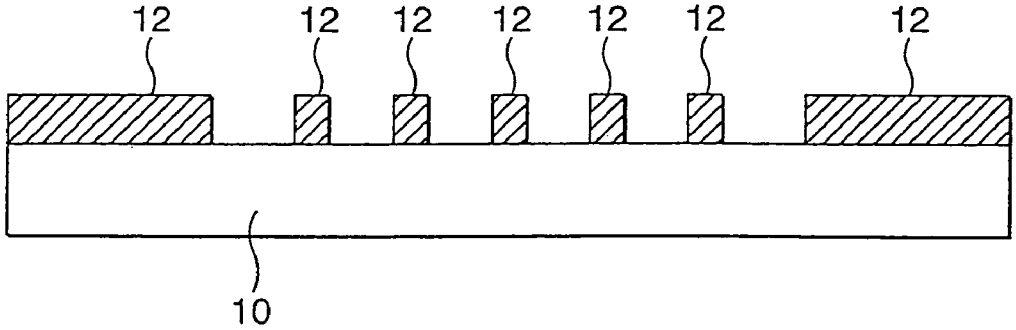
FIG. 3 is a cross-sectional view (part 2) showing the method of manufacturing the high-frequency coil device according to the first embodiment of the present invention.

First, a Cu base metal plate 10 having a thickness of 80 to 150 μm is prepared as shown in FIG. 2. As shown in FIG. 3, a resist film is coated on the surface of the base metal plate 10, and then a predetermined coil pattern, for example, a spirally-shaped resist pattern 12 having a fine pitch is formed by using the photolithography technique. At this time, the side wall of the resist pattern 12 is made substantially vertical and the interval between the resist pattern 12 is made uniform with high precision by the micro-processing using the photolithography technique.

Figure 4:
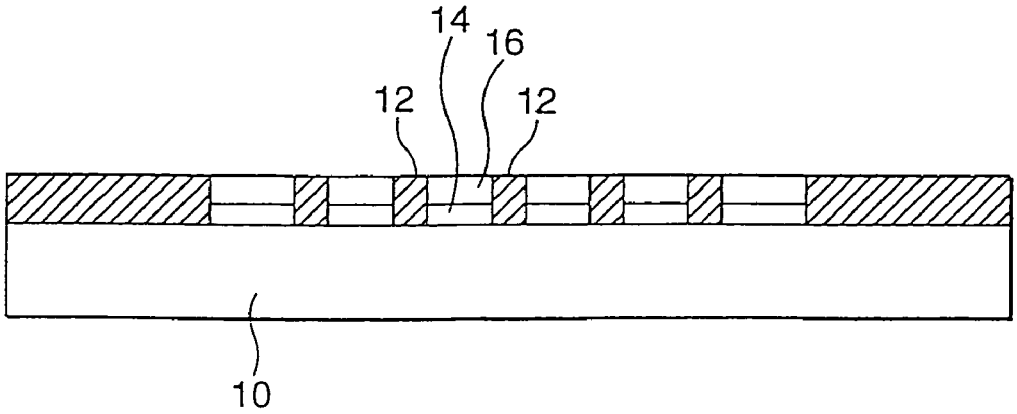
FIG. 4 is a cross-sectional view (part 3) showing the method of manufacturing the high-frequency coil device according to the first embodiment of the present invention.

Subsequently, as shown in FIG. 4, an Ni-plating treatment and a Cu-plating treatment are successively conducted on the exposed surface of the base metal plate 10 by using the resist pattern 12 as a mask to laminate an Ni-plating layer 14 having a thickness of 15 μm and a Cu-plating layer 16 having a thickness of 25 μm successively. At this time, since the shape of the Ni-plating layer 14 and the Cu-plating layer 16 is regulated by the resist pattern 12, the side surface thereof is substantially vertical and the width thereof is uniform with high precision.

Figure 5:
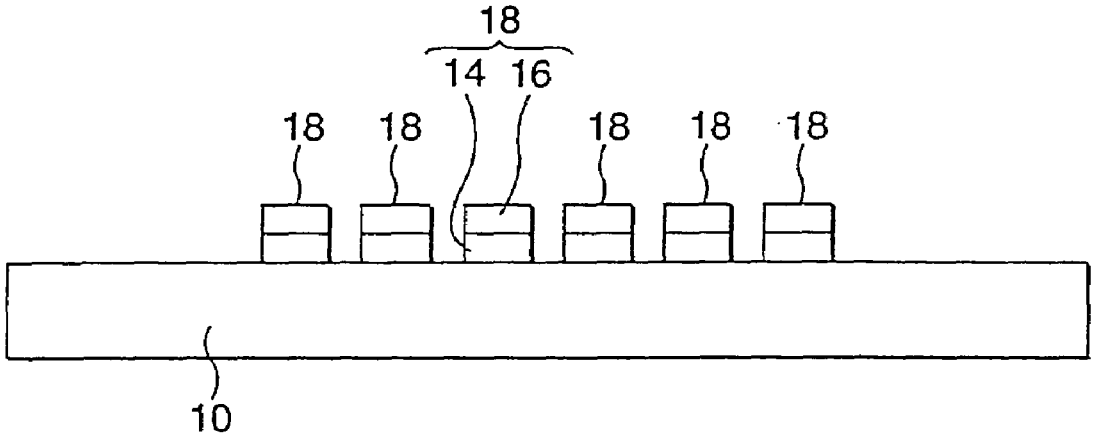
FIG. 5 is a cross-sectional view (part 4) showing the method of manufacturing the high-frequency coil device according to the first embodiment of the present invention.

Subsequently, the resist pattern 12 is peeled off as shown in FIG. 5. As described above, the spirally-shaped fine-pitch coil 18 having the Ni—Cu laminate structure in which the Ni-plating layer 14 of 15 μm in thickness and the Cu-plating layer 16 of 25 μm in thickness are laminated successively is formed on the surface of the base metal plate 10. In the spirally-shaped coil 18, the side surface thereof is substantially vertical and the width thereof is uniform with high precision.

Figure 6:
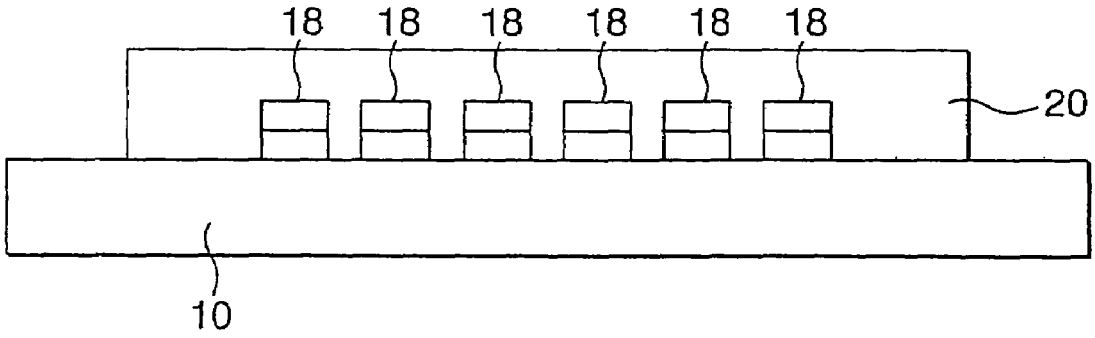
FIG. 6 is a cross-sectional view (part 5) showing the method of manufacturing the high-frequency coil device according to the first embodiment of the present invention.

Subsequently, as shown in FIG. 6, after a polyimide layer 20 is coated on the overall surface of the substrate, resist is coated on the polyimide layer 20, and then a resist pattern having a predetermined shape (not shown) is formed by using the photolithography technique. By using this resist pattern, the polyimide layer 20 is patterned into such a shape as to cover the area in which the spirally-shaped coil 18 is formed. The surface and the side surface of the spirally-shaped coil 18 are coated and protected by the polyimide layer 20 thus formed.

Figure 7:
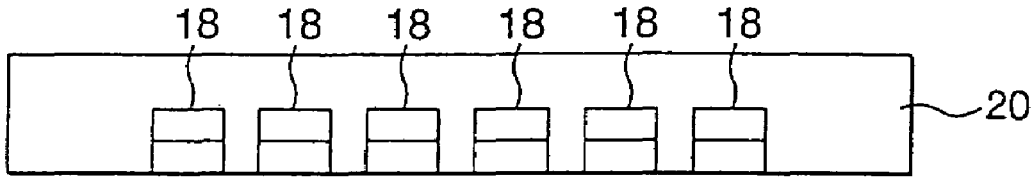
FIG. 7 is a cross-sectional view (part 6) showing the method of manufacturing the high-frequency coil device according to the first embodiment of the present invention.

Subsequently, as shown in FIG. 7, the base metal plate 10 is removed by etching it from the back surface side, thereby exposing the back surface of the polyimide layer 20, and the back surface of the spirally-shaped coil 18 which is coated with the polyimide layer 20 on the surface and side surface thereof, that is, the surface of the coil 18 on which the Ni-plating layer 14 is coated.

Figure 8:
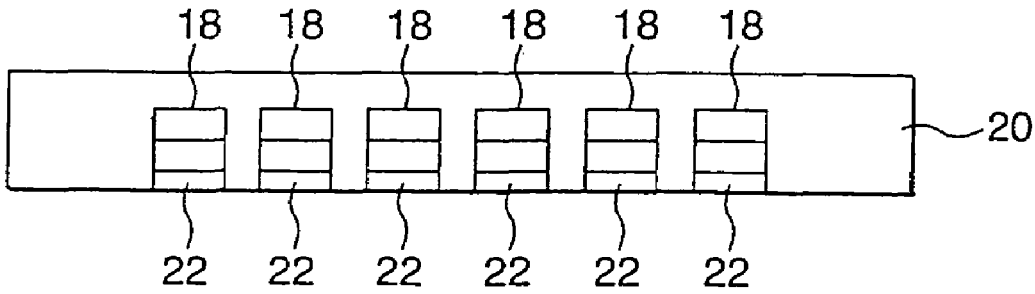
FIG. 8 is a cross-sectional view (part 7) showing the method of manufacturing the high-frequency coil device according to the first embodiment of the present invention.

Subsequently, as shown in FIG. 8, an Au plating treatment is conducted on the surface of the Ni-plating layer 14 serving as the back surface of the spirally-shaped coil 18 thus exposed to form an Au plating layer 22 of 0.3 to 5 μm in thickness. As described above, the back surface of the spirally-shaped coil 18 whose surface and side surface are coated with the polyimide layer 20, that is, the surface of the coil 18 which is coated with the Ni-plating layer 14 is coated with the Au plating layer 22, and also the back surface of the Au plating layer 22 is substantially flushed with the back surface of the polyimide layer 20.

In the spirally-shaped coil 18 whose Ni-plating layer surface coated with the Au plating layer 22, the Ni plating layer 14 is interposed between the Cu plating layer 16 serving as the main portion of the coil 18 and the Au plating layer 22, and the Ni plating layer 14 functions as a diffusion barrier for Au and Cu.

Finally, wire bonding is carried out to connect the center portion of the spirally-shaped coil 18 (more accurately, the Au plating layer 22 coated on the surface of the coil 18 at the center portion) to the signal line 24 formed simultaneously with the coil 18 in the same process (more accurately, the Au plating layer 22 coated on the surface of the signal line) by the Au wire 26 as shown in FIG. 1.

In this wire bonding, excellent connection can be also implemented because the Ni plating layer 14 having relatively high rigidity exists on the base of the Au plating layer 22.

As described above, there is manufactured a high-frequency coil device having such a structure that the spirally-shaped coil 18 having a fine pitch is embedded in the surface of the polyimide layer 20 and the bottom surface and the side surface thereof are coated by the polyimide layer 20.

As described above, according to the high-frequency coil device of the present invention, the spirally-shaped fine-pitch coil 18 is embedded in the surface of the polyimide layer 20, and the bottom surface and side surface of the coil 18 are coated with the polyimide layer 20, so that a stable Q value can be achieved. Further, the surface of the high-frequency coil device comprising the spirally-shaped coil 18 (the Au plating layer 22 coated on the surface) and the polyimide layer 20 is set to be substantially flat, so that joint of LSI chip, particularly flip chip joint using ACF (Anisotropic Conductive Film) can be easily performed.

Further, according to the high-frequency coil device manufacturing method of the present invention, the resist pattern 12 which is designed to have substantially the vertical side wall and the highly precisely uniform pattern interval by the microprocessing using the photolithography technique is formed on the surface of the base metal plate 10, and the Ni-plating layer 14 and the Cu-plating layer 16 are successively laminated on the exposed surface of the base metal plate 10 by using the resist pattern 12 as a mask, whereby the side surface of the spirally-shaped fine-pitch coil 18 having the Ni—Cu laminate structure can be made substantially vertical and the width thereof can be made uniform with high precision, thereby suppressing the dispersion in sectional area at maximum and thus reducing the dispersion of the coil impedance. In addition, by reducing the dispersion of the coil impedance, a high-frequency coil device having a high Q value for GHz band can be implemented.

In the first embodiment, as the method of achieving such a structure that the Au-plating layer 22 is coated on the surface of the spirally-shaped coil 18 having the Ni—Cu laminate structure in which the Ni-plating layer 14 and the Cu-plating layer 16 are successively laminated, the Ni-plating treatment and the Cu-plating treatment are successively conducted on the exposed surface of the base metal plate 10 by using as a mask the spirally-shaped fine-pitch resist pattern 12 formed on the surface of the base metal plate 10 to form the spirally-shaped fine-pitch coil 18 having the Ni—Cu laminate structure in which the Ni-plating layer 14 and the Cu-plating layer 16 are successively laminated, and then the polyimide layer 20 is formed so as to be coated on the surface and side surface of the spirally-shaped coil 18. Further, the base metal plate 10 is etched and removed from the back surface side thereof to expose the back surface of the polyimide layer 20 and the back surface of the spirally-shaped coil 18, that is, the surface coated with the Ni-plating layer 14. Thereafter, the Au-plating treatment is conducted on the surface of the Ni-plating layer 14 to form the Au-plating layer 22.

However, the manufacturing method is not limited to the above method, and the following method may be used. In order to make the understanding easy, the same elements as described above are represented by the same reference numerals.

That is, an Ni-plating treatment, an Au-plating treatment, an Ni-plating treatment and a Cu-plating treatment are successively carried out on the exposed surface of the base metal plate 10 by using as a mask the spirally-shaped fine-pitch resist pattern 12 formed on the surface of the base metal plate 10 to form a spirally-shaped fine-pitch coil 18 having an Ni—Au—Ni—Cu laminate structure in which an Ni-plating layer, an Au-plating layer 22, an Ni-plating layer 14 and a Cu-plating layer 16 are successively laminated (however, an Au-plating layer 22 and an Ni-plating layer have been laminated at the lower layer portion of the coil 18). Thereafter, a polyimide layer 20 is formed so as to cover the surface and side surface of the spirally-shaped coil, and further the base metal plate 10 is etched and removed from the back surface side thereof to expose the back surface of the polyimide layer 20 and the Ni-plating layer surface laminated on the lower layer of the spirally-shaped coil 18. Subsequently, the Ni-plating layer is etched and removed to expose the Au-plating layer 22 formed at the lower layer portion of the spirally-shaped coil 18.

As described above, there can be implemented such a structure that the surface of the spirally-shaped coil 18 having the Ni—Cu laminate structure in which the Ni-plating layer 14 and the Cu-plating layer 16 are successively laminated is coated with the Au-plating layer 22.

(Second Embodiment)

Figure 9A:
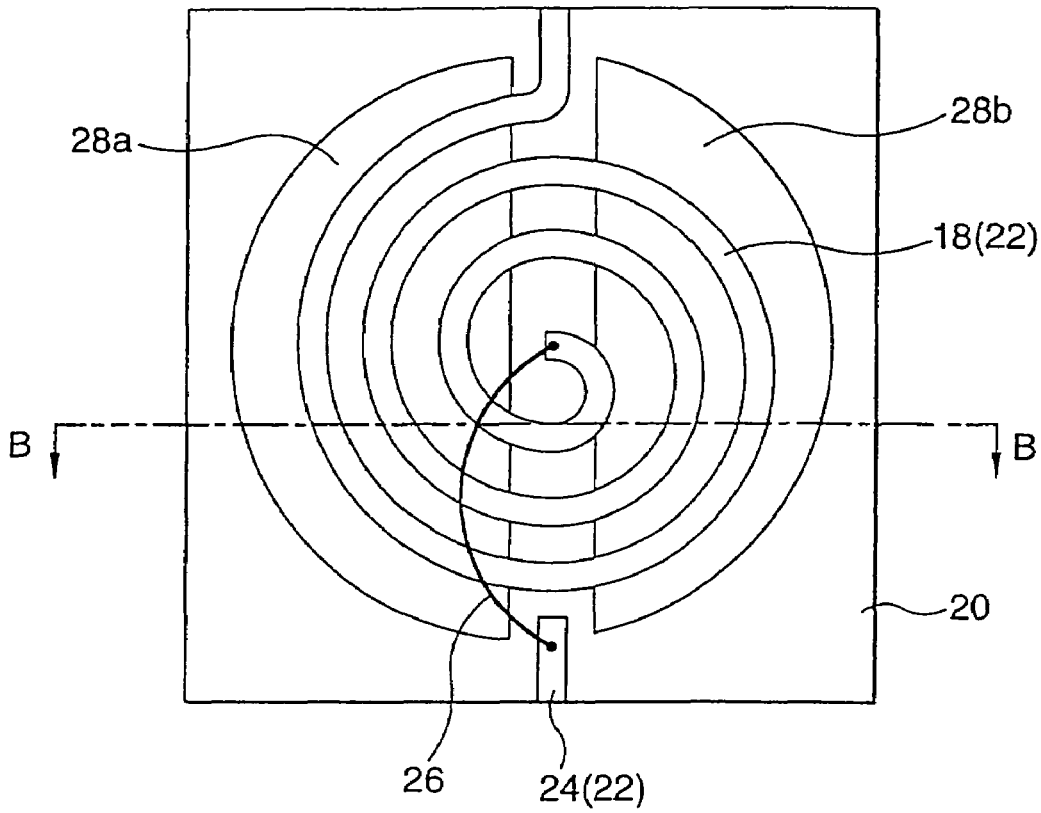
FIG. 9A is a cross-sectional view showing a high-frequency coil device according to a second embodiment of the present invention.
Figure 9B:
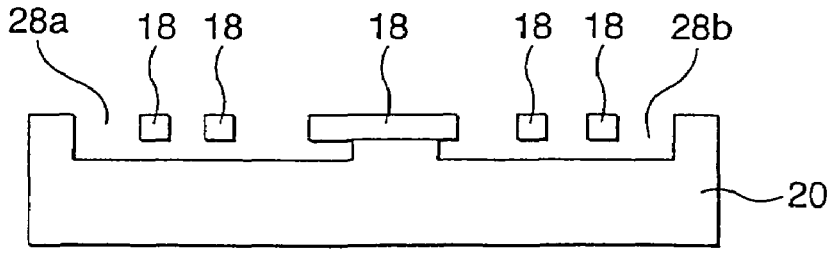
FIG. 9B is a cross-sectional view of a line B—B of FIG. 9A.
Figure 10A:
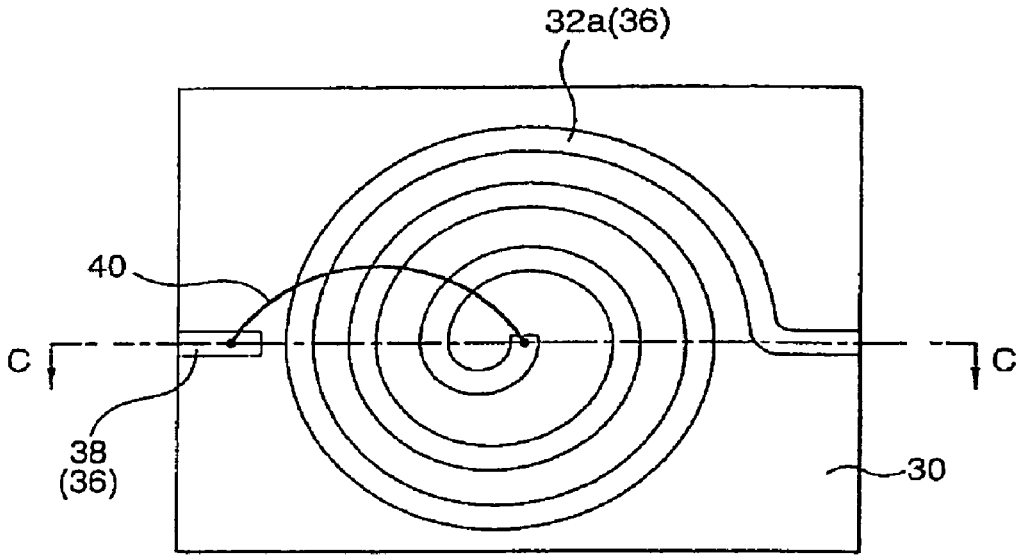
PRIOR ART FIG. 10A
FIG. 10A is a cross-sectional view showing a conventional high-frequency coil device.
Figure 10B:
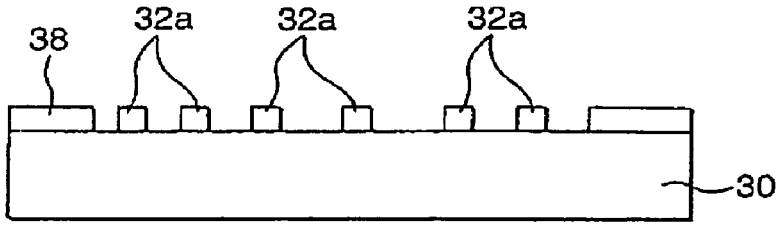
PRIOR ART FIG. 10B
FIG. 10B is a cross-sectional view taken along a line C—C of FIG. 10A.
Figure 10C:
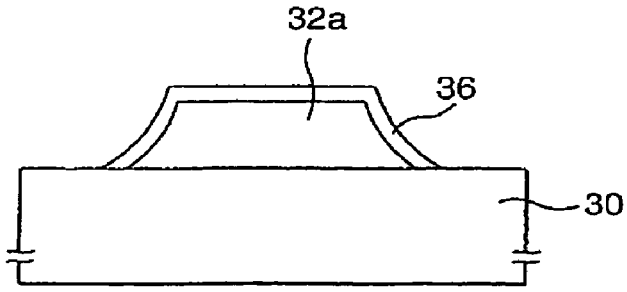
PRIOR ART FIG. 10C
FIG. 10C is a partially enlarged view of FIG. 10B.
Figure 11:
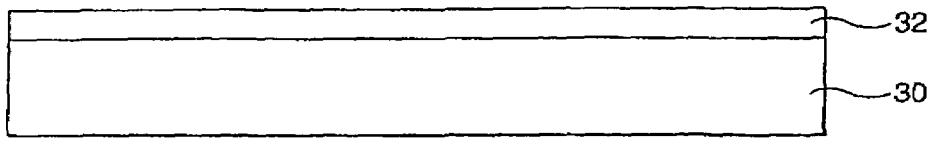
PRIOR ART FIG. 11
FIG. 11 is a cross-sectional view (part 1) showing a conventional high-frequency coil device manufacturing method.
Figure 12:
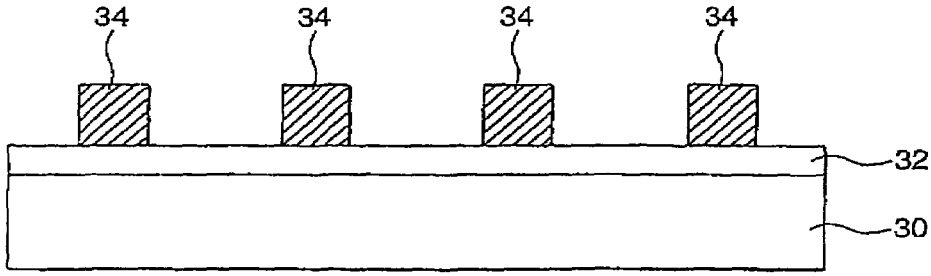
PRIOR ART FIG. 12
FIG. 12 is a cross-sectional view (part 2) showing the conventional high-frequency coil device manufacturing method.
Figure 13:
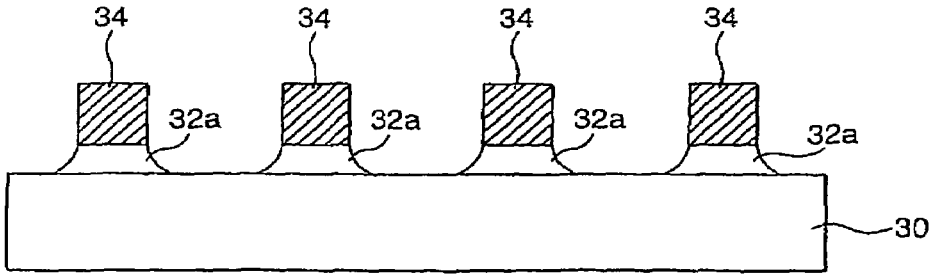
PRIOR ART FIG. 13
FIG. 13 is a cross-sectional view (part 3) showing the conventional high-frequency coil device manufacturing method.
Figure 14:
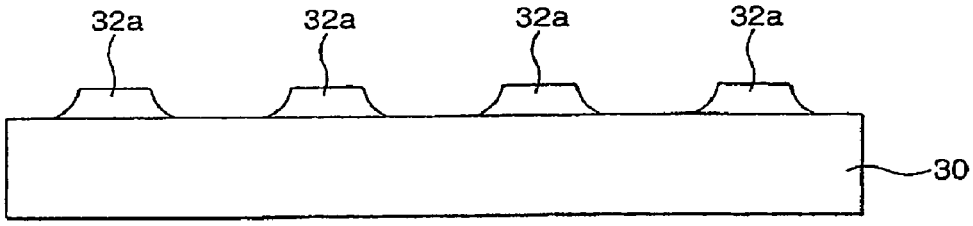
PRIOR ART FIG. 14
FIG. 14 is a cross-sectional view (part 4) showing the conventional high-frequency coil device manufacturing method.
Figure 15:
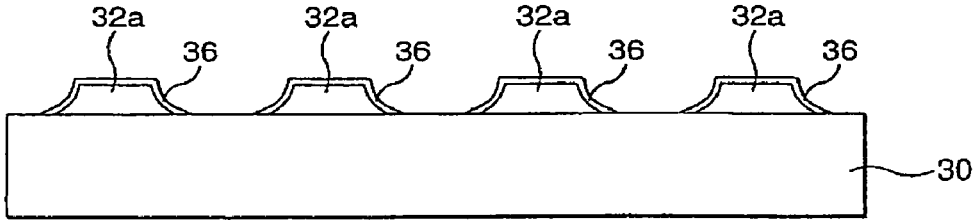
PRIOR ART FIG. 15
FIG. 15 is a cross-sectional view (part 5) showing the conventional high-frequency coil device manufacturing method.

FIG. 9A is across-sectional view showing a high-frequency coil device according to a second embodiment of the present invention, and FIG. 9B is a cross-sectional view taken along a line B—B of FIG. 9A. The same elements as the high-frequency coil device shown in FIG. 1 in the first embodiment are represented by the same reference numerals, and the description of these elements is omitted.

As shown in FIGS. 9A and 9B, the high-frequency coil device according to this embodiment has substantially the same construction as the high-frequency coil device shown in FIG. 1, however, it is characterized in that two semispherical recesses 28*a* and 28*b* are formed on the surface of the polyimide layer 20.

Therefore, the spirally-shaped fine-pitch coil 18 is embedded in the surface of the polyimide layer 20 as a whole, and the surface of the high-frequency coil device is substantially flat. However, the portions of the spirally-shaped coil 18 which are located within the recesses 28*a* and 28*b* are designed as aerial wires separated from the polyimide layer 20.

The spirally-shaped coil 18 thus constructed is supported by the polyimide layer 20 in an area sandwiched between the two semispherical recesses 28*a* and 28*b*. That is, the bottom surface and the side surface of the spirally-shaped coil 18 are coated and held by the polyimide layer 20 in only the area sandwiched between the two semispherical recesses 28*a*, 28*b*.

As described above, the spirally-shaped coil 18 is embedded in the surface of the polyimide layer 20 as a whole, and most of it is structured as an aerial wire separated from the polyimide layer 20, thereby constructing the high-frequency coil device.

The manufacturing method of the high-frequency coil device according to this embodiment is substantially the same as the manufacturing method of the first embodiment described with reference to FIGS. 2 to 8, and only the step of forming the polyimide layer 20 shown in FIG. 6 is different. Therefore, the illustration and description are omitted.

As described above, according to the high-frequency coil device of this embodiment, in addition to the effect of the first embodiment, most of the spirally-shaped coil 18 is constructed as an aerial wire separated from the polyimide layer 20 to thereby further enhance the Q value, so that there can be implemented a high-frequency coil device suitably usable for a frequency band of 5 GHz or more.

Further, according to the manufacturing method of the high-frequency coil device of this embodiment, the same effect as the first embodiment can be achieved.

In the first and second embodiments, the coil 18 is designed in a spiral shape. However, the coil pattern is not limited to the spiral shape, and the present invention may be applied to a coil having meander pattern.

Further, in the above embodiments, the polyimide layer 20 is used as the dielectric substrate, however, a liquid crystal polymer layer or the like may be used in place of the polyimide layer 20.

As described above in detail, the high-frequency coil device and the manufacturing method therefor according to the present invention have the following effects.

That is, according to the high-frequency coil device according to the first aspect of the present invention, the coil formed of a conductive layer having a predetermined coil pattern is embedded in the surface of the dielectric substrate, and the bottom surface and side surface of the coil is covered by the dielectric substrate. Therefore, a stable Q value can be achieved, and thus a high-frequency coil device having a stable Q value for GHz band can be implemented. Further, the surface of the high-frequency coil device comprising the coil and the dielectric substrate is made substantially flat, so that it can be joined to other semiconductor integrated circuit chips.

Further, according to the high-frequency coil device of the second aspect of the present invention, the coil is designed as an aerial wire separated from the dielectric substrate in the recesses formed on the substrate of the dielectric substrate. Therefore, the Q value can be further enhanced, and thus a high-frequency coil device having a stable high Q value for GHz band can be implemented.

Still further, according to the manufacturing method of the high-frequency coil device of the third aspect of the present invention, when a resist pattern having a predetermined coil pattern is formed on the surface of a base metal plate, the resist pattern is designed to have a substantially vertical side wall and a highly precisely uniform pattern interval by the microprocessing technique, and a plating layer is formed on the exposed surface of the base metal plate by using the resist pattern as a mask to form the coil of the plating layer. Therefore, the dispersion in sectional area of the coil can be suppressed at maximum by making the side surface of the coil substantially vertical and also making the width of the coil uniform with high precision. Accordingly, the dispersion in coil impedance can be reduced. Further, the reduction of the coil impedance implements a high-frequency coil device having a high Q value for GHz band.

What is claimed is:

1. A method of manufacturing a high-frequency coil device having a stable Q value, comprising:

providing a dielectric substrate; and forming a coil comprised of a conductive layer in a predetermined coil pattern embedded in the surface of said dielectric substrate, wherein portions of the bottom surface and side surface of said coil are covered by said dielectric substrate, and said coil has other portions which have a gap between a bottom surface of the coil and the substrate, and wherein said high-frequency coil device has the stable Q value.

2. The method of manufacturing a high-frequency coil device as claimed in claim 1, wherein said dielectric substrate is a polyimide layer or a liquid crystal polymer layer.

3. The method of manufacturing a high-frequency coil device as claimed in claim 1, wherein said conductive layer has a multi-layered structure in which a nickel plating layer and a copper plating layer are laminated.

4. A method of manufacturing a high-frequency coil device having a stable Q value, comprising:

providing a dielectric substrate; and forming a coil comprised of a conductive layer, wherein portions of the bottom surface and side surface of said coil are covered by said dielectric substrate, and said coil has other portions which have a gap between a bottom surface of the coil and the substrate, and wherein said high-frequency coil device has a stable Q value.

5. The method of manufacturing a high-frequency coil device as claimed in claim 4, wherein said dielectric substrate is a polyimide layer or a liquid crystal polymer layer.

6. The method of manufacturing a high-frequency coil device as claimed in claim 4, wherein said conductive layer has a multi-layered structure in which a nickel plating layer and a copper plating layer are laminated.

* * * * *